United States Patent [19]

Nopper et al.

[11] Patent Number: 4,997,607

[45] Date of Patent: Mar. 5, 1991

[54] PROCESS FOR THE PRODUCTION OF A FIBROUS MAT

[75] Inventors: Herbert Nopper, Kuppenheim; Reinhard Wirth, Gaggenau, both of Fed. Rep. of Germany

[73] Assignee: Casimir Kast Formteile GmbH & Co., Gernsbach, Fed. Rep. of Germany

[21] Appl. No.: 346,705

[22] Filed: May 3, 1989

[30] Foreign Application Priority Data

May 3, 1988 [DE] Fed. Rep. of Germany ..... 3814996

[51] Int. Cl.[5] ..... D04H 1/60

[52] U.S. Cl. ..... 264/118; 264/120; 264/122; 264/128; 264/136; 264/137; 264/145

[58] Field of Search ..... 264/120, 128, 118, 136, 264/137, 145, 160, 122; 156/62.2

[56] References Cited

U.S. PATENT DOCUMENTS

| | | | |
|---|---|---|---|
| 2,677,008 | 4/1954 | Fairclough et al. | 264/128 |
| 2,983,627 | 5/1961 | Williams | 264/128 |
| 3,764,451 | 10/1973 | Dunning | 264/128 |
| 4,028,457 | 6/1977 | Davey | 264/120 |
| 4,057,669 | 11/1977 | McConnell | 264/118 |
| 4,294,782 | 10/1981 | Frochlig | 264/145 |
| 4,623,575 | 11/1986 | Brooks et al. | 264/128 |

*Primary Examiner*—Mary Lynn Theisen

*Attorney, Agent, or Firm*—Antonelli, Terry, Stout & Kraus

[57] ABSTRACT

Low density fibrous mats formed from fibres and thermosetting and thermoplastic binders, transformed by moulding at elevated temperatures are used for the production of mouldings. Such fibrous mats are produced in that a mixture of fibres and binders is spread out to form a fleece and the latter is compressed or compacted to a mat at high temperature. For the planned influencing of the characteristics of the moulding, while simultaneously reducing the binder requirement and the density, it is proposed that the fibrous mat or blanks thereof is passed through a pair of rollers with polished surfaces and by means of at least one roller binder is applied from the aqueous phase to the side of the fibrous mat facing the same under pressure action and that the fibrous mat is passed through the roller pair at a speed lower than the circumferential speed thereof and following onto the roller pair is passed through a drying zone.

21 Claims, No Drawings

PROCESS FOR THE PRODUCTION OF A FIBROUS MAT

The invention relates to a process for the production of a low density fibrous mat from fibres, as well as thermosetting and thermoplastic binders, which can be transformed into mouldings by moulding at high temperature, in that a mixture of fibres and binders are spread out to form a fleece and the latter is compacted to a transportable fibrous mat at high temperature.

In a known process of this type (DE 28 45 112 C3), the fibres are ground together with the dry binder into powder form, simultaneously mixed and said mixture is spread out to form a fleece, which is subsequently compressed or compacted to a mat at elevated temperature. The heat supplied leads to a partial activation of the binder or certain components, particularly the thermoplastic components, so that a fibre union is obtained which, although having a low density, has adequate transportation and storage stability. The mat is then split up into transportable and handlable blanks. From the fibrous mat or the blanks are then produced mouldings by moulding at elevated temperature and they can be used for the most varied purposes, e.g. as parts for the internal panelling or lining of motor vehicles, as furniture mouldings, etc. In this process in particular the thermosetting components of the binder are activated and, following the moulding process, give the moulding the necessary dimensional stability.

In order to obtain special physical characteristics, e.g. an elevated wet strength and tropical climate stability, it is frequently necessary to introduce liquid or aqueous binders into the fibre mixture, in order to glue or adhere the individual fibres. In addition, additives are added to the mixture, which influence in a particular direction the chemical-physical characteristics. These e.g. include mould parting agents for the subsequent moulding process, water repellants, elasticators, fungicides, paint pigments, etc. Fibrous mats of the aforementioned type are processed in large numbers to mouldings and have proved highly satisfactory in practice.

However, it is a disadvantage of the known fibrous mats or the processes used for the production thereof that all the components which are admixed with the fibres are present in homogeneously distributed form throughout the mixture and therefore within the fibrous mat. Thus, the quantity of binders or additives necessary for a particular chemical-physical or technical behaviour of the moulding must be present in the entire cross-section of the mat or moulding.

The problem of the present invention is to influence in a local manner the physical, technical or chemical characteristics of the fibrous mat or the moulding produced therefrom in a clearly defined manner and to reduce the quantity of binders or additives to the extent necessary for a desired behaviour.

According to the invention this problem is solved in that the fibrous mat or blanks thereof are passed through a pair of rollers having polished surfaces and by means of at least one roller binder is applied from the aqueous phase to the fibrous mat side facing the same under pressure action and that the fibrous mat is passed through the pair of rollers with a speed lower than its circumferential speed and following the roller pair is passed through a drying zone.

It is admittedly known to surface-apply binders to fibrous mats, e.g. glass fibre mats, which has hitherto taken place by spraying, dipping, pouring by means of split nozzles or knife coating. However, all these known methods lead to a non-uniform binder application, particularly to a non-uniform surface, which does not allow further processing to mouldings or only when specific fibres are used. These processes in particular suffer from the disadvantage that not all the fibres are incorporated into the surface, i.e. no smooth surface is obtained. Streaks or air inclusions occur on the surface. In order to obtain a completely satisfactory surface quality, it has hitherto been necessary to form the fleece from two or more successively spread out fibre layers, each having the composition desired for the final moulding.

Practical tests with the inventive process have revealed that a roller application of binders from the aqueous phase leads to a completely satisfactory surface quality when use is made of polished steel rollers and the application occurs under slight pressure action and with a fibrous mat conveying speed lower than the circumferential speed of the rollers. Following the drying zone, a fibrous mat is obtained having a voluminous core with a very low density and more dense covering layers. The binders are enriched in the covering layers compared with the core layer. A low density and good dimensional stability are in particular sought for motor vehicle lining or panelling parts. Particularly for door panels, which are shaped from conventional fibrous mats, a density of 1.0 to 1.1 g/cm$^3$ is obtained, whereas when using the inventive process the density can be reduced to 0.7 to 0.8 g/cm$^3$, so that a lightweight, but still rigid panel is obtained. In the case of a roof covering, which must have highly damping or absorbing characteristics, densities between 0.05 (partial) and 0.1 g/cm$^3$ can be obtained with a wall thickness of up to 20 mm and high dimensional stability.

It is also possible to only incorporate certain additives into the covering layers, so as to achieve a specific surface quality. The binders applied by means of the rollers can also be chosen in such a way that the fibrous mat or the moulding produced therefrom fulfils certain surface requirements. Fibrous mats with this construction can in particular be processed to mouldings with a satisfactory smooth surface. It is also possible to obtain surfaces with a moisture barrier under varying climatic conditions, so that there is no need for the PE film or sheet hitherto used for this purpose, although deformations due to varying moisture content are excluded. In the case of direct painting or colouring of the moulding, the attainable smooth surface leads to a reduction in the amount of colour and paint required. However, if the moulding is lined, the adhesive required can be more sparingly used.

The inventive process can be performed in such a way that the binder is only applied from the aqueous phase to a single side. However, preference is given to an application to both sides, said application taking place simultaneously by means of a single pair of rollers.

According to a development of the inventive process binders with mainly thermosetting binder components are applied. Harder and more rigid mouldings can be produced from such a fibrous mat. It is also possible to apply binders with mainly thermoplastic binder fractions, which leads to more elastic mouldings.

In principle, the binder can be applied from a solution, an emulsion or a dispersion, preference being given to aqueous emulsions or dispersions. It is in particular possible to use as the thermosetting components phenol, resol, melamine or urea resins, whereas the thermoplastic components can be constituted by homopolymers or copolymers, such as acrylic resins, butadiene styrene, butadiene acrylonitrile, polyurethanes, polyesters and vinyl ester resins. Any random combination is also naturally possible for such a binder system.

As has already been intimated, it is possible to add to the aqueous phase of the binder additives which influence the physical, technical or chemical behaviour of the fibrous mat and/or the moulding produced therefrom and can be applied together with the binder to the fibrous mat. The additives can be constituted by water repellants, e.g. paraffin emulsions, mould parting agents, e.g. sulphonated fatty acids, elasticators, e.g. polyethylene glycols, which can react with certain binders, namely condensation resins, as well as fungicides, paint pigments, fire retardants, antioxidants, wetting agents, etc. In the same way as the binder application from the aqueous phase only influences the physical and technical behaviour of the moulding in the necessary parts of the layers, through adding additives, the characteristics sought by the latter in the covering layers of the fibrous mat are only obtained at the intended point. Thus, the binders or additives can not only be locally enriched in planned manner, but the quantity necessary for a particular property can be reduced to the necessary amount, because the binders or additives no longer have to be homogeneously distributed over the entire mat or moulding cross-section.

It is also possible to add to the aqueous phase of the binder in a proportional manner blowing agents or foamable resins becoming active at elevated temperature. These foamable resins are e.g. only added in connection with the shaping to a moulding, which takes place at elevated temperature. By this manner also in the covering layers a low density is reached with nevertheless sufficient hardness and surface quality. The inventive process also gives the possibility of adding to the fibrous mixture prior to the production of the fibrous mats exclusively binders in powder form, so that a dry processing of the fibrous mixture to a fleece is possible, the binders leading to fibre impregnation being applied by means of rollers.

It has proved advantageous if the binders are applied from an aqueous phase in a quantity between 10 and 150 $g/m^2$, preferably 60 and 80 $g/m^2$.

It has also proved advantageous if a binder solution, dispersion or emulsion with a solids content of 10 to 60 and preferably 30 to 40% by weight is used. This leads to a completely satisfactory surface on roller application.

In principle, the application of the binder can take place in a space and time separated manner from the production of the transportable fibrous mat and e.g. in the processing plant where the mouldings are produced, but preferably the fibrous mat is passed through the pair of rollers at the time of production following compression for making it transportable. Thus, a continuous process is obtained starting from the spreading out of the mixture to form a fleece and extending to the production of the fibrous mat with the desired characteristics in the covering layers.

The fibrous mat is preferably supplied to the roller pair at the elevated temperature necessary for compressing for rendering it transportable, followed by the application of the binder from the aqueous phase, so that the still present enthalpy of the fibrous mat can be utilized and its drying is accelerated.

It is also advantageous in this embodiment of the process if the spent air obtained during heating for the compression of the fibrous mat is used for drying the latter following the application of the binder from the aqueous phase, so that a favourable energy balance is obtained. Thus, unlike as hitherto, the fibrous mat is only dried following binder application and not following compression. This in particular leads to the advantage that the production of the fibrous mat is no more expensive than in the conventional system. The moisture is reduced from roughly 20% initially to 7 to 10%.

Finally, after drying, the fibrous mat is cooled, e.g. to $\leqq$ 40° C., in order to permit a stacking of the mat blanks, without them sticking together.

Examples are given hereinafter:

EXAMPLE 1

75% of phenolic resin (in a 35% solution), 3% of a parting agent emulsion (in a 50% emulsion) and 22% of an acrylate dispersion (in a 35% dispersion) are applied from the aqueous phase to a fibrous mat mainly with waste material fibres (paper, cardboard, jute, textiles). Very rigid mouldings can be produced from such a fibrous mat.

EXAMPLE 2

70% butadiene acrylonitrile (in a 45% dispersion), 8% polyethylene glycol 400 (low molecular weight), 5% water repellant (in 30% emulsion) and 13% melamine resin (in 50% dispersion) are applied to a fibrous mat formed from fibres of the aforementioned structure. Very flexible mouldings can be produced from such a fibrous mat.

EXAMPLE 3

60% phenolic resin (35% solution), 8% sodium hydrogen carbonate (foaming agent), 0.2% wetting agent, 3.8% water repellant (30% emulsion), 14% crosslinking acrylate dispersion (60% dispersion) and 14% thermoplastic acrylate dispersion (50% dispersion) are applied to a fibrous mat having fibres with the aforementioned structure. On moulding the fibrous mat at elevated temperature to a moulding, the resin components are foamed. A stable moulding of very low density is obtained.

We claim:

1. A process for the production of a low density fibrous mat from fibers, as well as thermosetting and thermoplastic binder, which can be transformed to a molding by molding at elevated temperature, wherein a mixture of fibers and binder is spread out to form a fleece and the fleece is compressed at elevated temperature to a transportable fibrous mat, said process further comprising the steps wherein the fibrous mat is passed through a pair of rollers with polished roller surfaces and by means of at least one roller a binder is applied from the liquid phase to the facing side of the fibrous mat under pressure and the fibrous mat is passed through the pair of rollers at a lower speed than the circumferential speed of the rollers and following the binder application, the mat is passed through a drying zone.

2. A process according to claim 1, wherein the binder from the liquid phase is applied by the rollers to both sides of the fibrous mat.

3. A process according to claim 1 wherein, on passing through the pair of rollers, the binder from the liquid phase is simultaneously applied to both sides of the fibrous mat.

4. A process according to claim 1, wherein the binder from the liquid phase comprises mainly thermosetting binder components.

5. A process according to claim 1 wherein the binder from the liquid phase comprises mainly thermoplastic binder components.

6. A process according to claim 1, wherein the binder from the liquid phase is applied from a solution, an emulsion or a dispersion.

7. A process according to claim 1, wherein the binder applied by the at lest one roller is in an aqueous phase to which are added additives which influence the physical and/or chemical behavior of the fibrous mat and/or the molding molded thereform.

8. A process according to claim 7, wherein at least one of water repellents, mold parting agents, elasticators, fungicides, and paint pigments are added to the aqueous phase of the binder.

9. A process according to claim 7, wherein blowing agents or foamable resin which become active at elevated temperature are proportionally added to the aqueous phase of the binder.

10. A process according to claim 1, wherein the quantity of thermosetting and thermoplastic binders necessary for the finished molding are partly added to a fiber mixture prior to the production of the fibrous mat and partly during application from an aqueous phase from the at least one roller.

11. A process according to claim 1, wherein prior to the production of the fibrous mat, exclusively binders in powder form are added to the mixture of fibers and binder.

12. A process according to claim 7, wherein the binder from the aqueous phase is applied in a quantity between 10 and 150 $g/m^2$.

13. A process according to claim 6, wherein a binder solution, dispersion or emulsion with a solids content of 10 to 60 by weight is used.

14. A process according to claim 1, wherein immediately following compression to make the fibrous mat transportable, the fibrous mat is passed through the roller pair for applying the binder from the liquid phase.

15. A process according to claim 1, wherein the fibrous mat is supplied to the roller pair for applying the binder from the liquid phase an at elevated temperature necessary for compression to make the mate transportable.

16. A process according to claim 1 wherein, following the application of the binder by the one roller, the fibrous mat is dried in said drying zone.

17. A process according to claim 1, wherein the liquid phase is an aqueous phase and spent air obtained during a drying process in connection with the compression of the fibrous mat is used for drying the fibrous mat following the application of the binder from the aqueous phase.

18. A process according to claim 17, wherein the fibrous mat is dried to a residual moisture content of 7 to 10%.

19. A process according to claim 18, wherein the fibrous mat is cooled after drying.

20. A process according to claim 19, wherein the fibrous mat is cooled to a temperature of $\leqq 40°$ C.

21. A process according to claim 20, wherein the fibrous mat is cut to size to form blanks after cooling and the blanks are stacked.

* * * * *